US007919914B2

(12) United States Patent
Takahashi et al.

(10) Patent No.: US 7,919,914 B2
(45) Date of Patent: Apr. 5, 2011

(54) DISCHARGE LAMP AND ELECTRODE FOR USE IN THE SAME

(75) Inventors: Hiroshi Takahashi, Fukushima (JP); Yukio Hara, Fukushima (JP); Masahiro Kikuchi, Tokyo (JP); Yoshiichi Horikoshi, Fukushima (JP); Hiroto Watanabe, Fukushima (JP); Ryouichi Yoshida, Fukushima (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/659,146

(22) Filed: Feb. 26, 2010

(65) Prior Publication Data

US 2010/0156270 A1 Jun. 24, 2010

Related U.S. Application Data

(63) Continuation of application No. 10/586,353, filed as application No. PCT/JP2005/000612 on Jan. 19, 2005, now Pat. No. 7,750,546.

(30) Foreign Application Priority Data

Jan. 20, 2004 (JP) ..... 2004-011960

(51) Int. Cl.
*H01J 1/62* (2006.01)

(52) U.S. Cl. ..... 313/492; 313/331

(58) Field of Classification Search ..... 313/30–311, 313/331, 332, 336, 351, 355, 613, 615, 631, 313/632, 491, 492; 445/46, 49–52
See application file for complete search history.

(56) References Cited

U.S. PATENT DOCUMENTS

| | | | | |
|---|---|---|---|---|
| 4,197,957 | A * | 4/1980 | Buhrer | 220/2.1 R |
| 5,304,893 | A * | 4/1994 | Nieda | 313/631 |
| 5,905,339 | A | 5/1999 | Chow et al. | |
| 6,383,416 | B1 | 5/2002 | Hamada et al. | |
| 6,417,607 | B1 | 7/2002 | Thielen | |

(Continued)

FOREIGN PATENT DOCUMENTS

JP 57-053043 A 3/1982

(Continued)

OTHER PUBLICATIONS

PCT International Search Report for PCT/JP2005/000612 mailed on May 17, 2005.

(Continued)

*Primary Examiner* — Joseph L Williams
*Assistant Examiner* — Andrew J Coughlin
(74) *Attorney, Agent, or Firm* — Rader, Fishman & Grauer PLLC

(57) ABSTRACT

It is possible to enhance the luminance of a cold-cathode type discharge lamp and to contribute to a prolongation of service life thereof. A discharge lamp 1 is provided with an electrode 3 having a cup 4 with such a shape that a bottom is provided at each of both opposed ends of the glass tube 2. The cup 4 is connected to a lead-in wire 8 which is inserted through the end of the glass tube 2 and held thereby. The collision-preventing ring 5 covering an end surface of the cup 4 is provided to the open end 4*a* of the cup 4. The porous tungsten disk 6 impregnated with a ternary metal oxide composed of barium (Ba), aluminum (Al), and calcium (Ca) as an electron emission material is provided at a bottom in an inside of the cup 4.

8 Claims, 2 Drawing Sheets

U.S. PATENT DOCUMENTS

2005/0057143 A1 3/2005 Chow et al.

FOREIGN PATENT DOCUMENTS

| | | | |
|---|---|---|---|
| JP | 02-186550 | A | 7/1990 |
| JP | 05-251044 | A | 9/1993 |
| JP | 10-223176 | A | 8/1998 |
| JP | 2002-245966 | A | 8/2002 |
| JP | 2002-313278 | A | 10/2002 |

OTHER PUBLICATIONS

Form PCT/IB/338—English translation of International Preliminary Examination Report dated Nov. 6, 2006.

* cited by examiner

DISCHARGE LAMP AND ELECTRODE FOR USE IN THE SAME

CROSS REFERENCE TO RELATED APPLICATIONS

The present application is a Continuation Application of patent application Ser. No. 10/586,353, filed Jun. 25, 2008 now U.S. Pat. No. 7,750,546, which is a national stage application of PCT/JP2005/000612 filed Jan. 19, 2005, which claims priority to Japanese Patent Application JP2004-011960 filed on Jan. 20, 2004, the entire contents of which are herein incorporated by reference.

TECHNICAL FIELD

The present invention relates to a cold-cathode type discharge lamp and an electrode for use in the same. More specifically, it relates to equipping an electron emission member containing an electron emission material therein into a cup so that a luminous efficiency can be enhanced and a high luminance can be produced.

BACKGROUND ART

Conventionally, a discharge lamp has been used that employs fluorescent substance as a light source. Among the discharge lamps, a cold-cathode type discharge lamp has been used as a backlight for a liquid crystal display (LCD) because a diameter of its glass tube can be reduced.

The cold-cathode type discharge lamp has a configuration in which its glass tube is equipped with electrodes at its opposed ends, a rare gas such as Argon and mercury are enclosed in an inside space of the glass tube, and fluorescent substance is coated into an interior of the glass tube.

FIG. 1 is a cross-sectional view of important components of a configuration of a conventional cold-cathode type discharge lamp. The discharge lamp 51 is equipped with an electrode 53 at each of the two opposed ends of its glass tube 52. A rare gas such as argon gas and mercury are enclosed in an inside space of the glass tube 52 and any fluorescent substance 52*a* is coated to a predetermined region in an interior of the glass tube 52.

The electrode 53 has a cup 54. The cup 54 has such a shape that a bottom is provided therein and one end thereof is open, and the cup 54 is connected to a forward end of a lead-in wire 55 which is inserted through an end of the glass tube 52 and held in position thereby.

The light emission principle of the cold-cathode type discharge lamp 51 will be explained as follows: when a voltage is applied between the electrodes 53 at a high frequency, glow discharge occurs so as to emit electrons from the cup 54. The electrons emitted from the cup 54 are accelerated, thereby colliding mercury atoms in such a way as to excite them. The mercury atoms thus excited emit ultraviolet light. This ultraviolet light is converted into a visible light by the fluorescent substance 52*a*, thereby rendering the discharge lamp 51 luminiferous.

The conventional cold-cathode type discharge lamps face a problem such that a large drop in cathode voltage occurs during operations. In other words, it faces a problem such that a large quantity of power can be dissipated by the electrodes themselves but fails to contribute to light emission, thus resulting in a low luminous efficiency relative to dissipation power.

Further, they suffer from such a problem that so-called ion sputtering in which any ions generated during discharge collide with electrodes and so waste them occurs to a conspicuous degree. As the cup wastes away, it becomes incapable of emitting a sufficient quantity of electrons, thus resulting in a diminution in the luminance. This brings about a problem of a shortened service life of the electrodes. Such the shortened service life of the electrodes in turn results in a limited service life of the discharge lamp.

DISCLOSURE OF THE INVENTION

In view of the above, and in order to solve these problems, the present invention has been developed, and it is an object of the present invention to provide a discharge lamp and an electrode for use in the same that can enhance a luminous efficiency and produce a high luminance.

In order to solve these problems, a discharge lamp related to the present invention has an electrode at each of two opposed ends of a glass tube in which a gas containing a light-emitting material is enclosed and to an interior of which fluorescent substance is coated, wherein the electrode is provided with an electron emission member containing an electron emission material in a cup having such a shape that a bottom is provided therein and one end thereof is open, and wherein the electrode is provided with a ring-shaped collision-preventing member at the open end of the cup, the collision-preventing member having a sleeve portion and a flange portion, the sleeve portion having an outer diameter by which the sleeve portion is fitted to an opening of the cup and being fixed to the cup, and the flange portion having an outer diameter by which the flange portion covers the entire open end of the cup and covering the forward open end of the cup.

According to the discharge lamp related to the present invention, by applying a voltage between two electrodes at a high frequency, glow discharge occurs. The glow discharge heats an electron emission member, and in turn, an electron emission material emits electrons. For example, by impregnating a porous electron emission member with electron emission material, this electron emission material can enter the member in quantity, thereby creating a situation in which electrons can be easily emitted. This enables voltage drop characteristics to be enhanced.

The accelerated electrons collide with a light-emitting material to excite it, thereby emitting ultraviolet light, for example. Then, this ultraviolet light collides with fluorescent substance to be converted into a visible light, thereby rendered the discharge lamp luminiferous.

Although the cup generally wears as ions generated during discharge collide with the electrodes, equipping an open end of the cup with a collision-preventing member to cover the forward end of the cup prevents the ions from colliding with the cup, thereby inhibiting wearing of the cup.

Further, because the electron emission member is attached to a bottom of the cup, the ions are prevented from colliding with the electron emission member, thereby inhibiting scattering of the electron emission material.

A discharge lamp electrode according to the invention, equipped to each of two opposed ends of a glass tube in which a gas containing a light-emitting material is enclosed and to an interior of which fluorescent substance is coated, has an electron emission member containing an electron emission material in a cup having such a shape that a bottom is provided therein and one end thereof is open, and a ring-shaped collision-preventing member provided at the open end of the cup, the collision-preventing member having a sleeve portion and a flange portion, the sleeve portion having an outer diameter by which the sleeve portion is fitted to an opening of the cup and being fixed to the cup, and the flange portion having an outer diameter by which the flange portion covers the entire open end of the cup and covering the forward open end of the cup.

According to the discharge lamp electrode related to the present invention, by applying voltage at a high frequency between the two electrodes attached to the opposed ends of the glass tube, glow discharge occurs. This glow discharge heats the electron emission member, and in turn, the electron emission material emits electrons. For example, impregnating the porous electron emission member with an electron emission material enables this electron emission material to enter the porous electron emission member in quantity, thereby creating a condition where electrons can easily be emitted.

BEST MODE FOR CARRYING OUT THE INVENTION

An embodiment of a discharge lamp and an electrode for use in the same of the present invention will be described below with reference to drawings.

1. Configurations of Discharge Lamp and Electrode

Figure 2A:
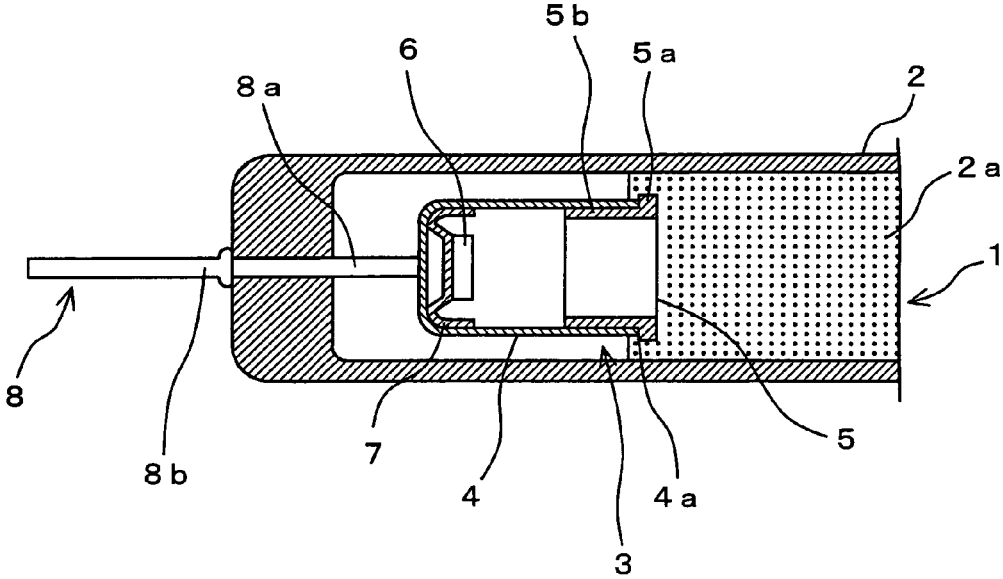
FIG. 2A is a cross-sectional view of important components of a configuration of a discharge lamp of the present embodiment.
Figure 2B:
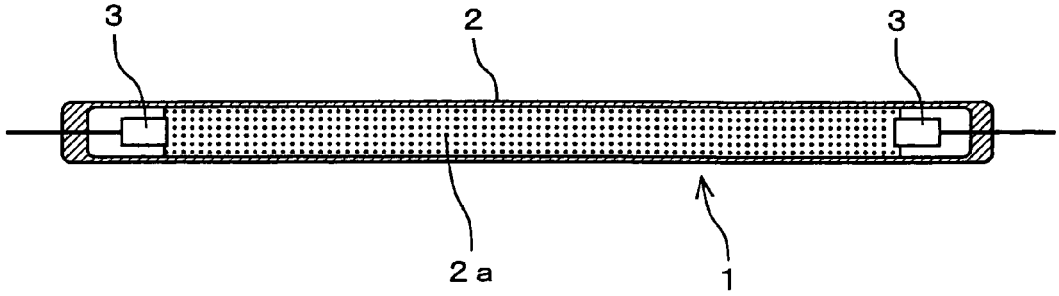
FIG. 2B is another cross-sectional view of important components of the configuration of the discharge lamp of the present embodiment.
Figure 3:
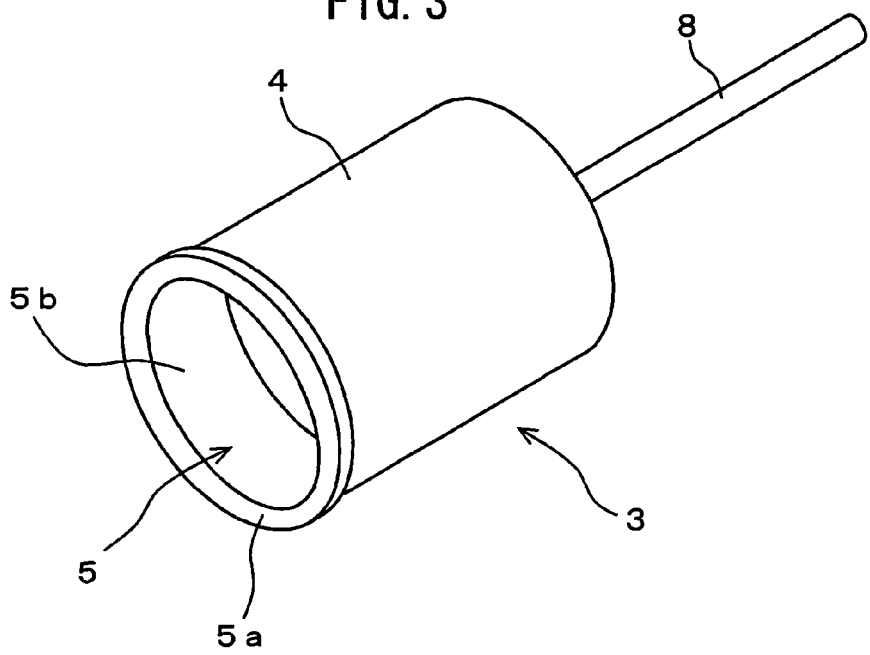
FIG. 3 is a perspective view of a configuration of a discharge lamp electrode of the present embodiment.

FIGS. 2A and 2B are cross-sectional views of a configuration of the discharge lamp of the present embodiment and FIG. 3 is a perspective view of the configuration of the discharge lamp electrode of the present embodiment. It should be noted that FIG. 2A is a cross-sectional view of the important components of an end taken along a plane including an axis of a tube and that FIG. 2B is an overall cross-sectional view of the discharge lamp. Further, FIG. 3 is a perspective view of the electrode, as viewed from a forward end thereof.

A discharge lamp 1 of the present embodiment is a cold-cathode type discharge lamp having a rod-shaped glass tube 2 with a small diameter, which is provided with an electrode 3 at each of both opposed ends thereof. Fluorescent substance 2*a* is coated to a predetermined region in an interior of the glass tube 2. Further, in an inside of the glass tube 2, rare gas such as argon (Ar), or neon (Ne), and mercury (Hg), which is light-emitting material, are enclosed.

The electrode 3 has a cup 4. The cup 4 is made of nickel (Ni), molybdenum (Mo), or niobium (Nb), etc. and has such a cylindrical shape as to have a bottom and to be open at its forward end. At an open end 4*a* of the cup 4, a collision-preventing ring 5 is attached. The collision-preventing ring 5, which is one example of a collision-preventing member, is made of a ceramic composed of a metal oxide such as an aluminum oxide ($Al_2O_3$), zirconium oxide ($ZrO_2$), silicon oxide ($SiO_2$) or magnesium oxide (MgO).

The collision-preventing ring 5 is comprised of a flange portion 5*a*, which covers an end surface of the open end 4*a* of the cup 4, and a sleeve portion 5*b*, which fits onto the open end 4*a*. The flange portion 5*a* covers the entire open end 4*a* and, therefore, has a diameter slightly larger than that of the cup 4. The sleeve portion 5*b* has almost an identical diameter to the inner diameter of the cup 4.

By inserting this sleeve portion 5*b* into the open end 4*a* of the cup 4 and irradiating, for example, with a laser beam along the open end 4*a* so that the open end 4*a* can be partially deformed by its heat, the sleeve portion 5*b* is caulked at the open end 4*a*. Thus, the collision-preventing ring 5 is fixed to the cup 4 so that a forward end of the cup 4 is covered by the flange portion 5*a* of the collision-preventing ring 5. It should be noted that since the collision-preventing ring 5 is ring-shaped, its inside is open.

Further, the electrode 3 has a tungsten disk 6. The tungsten disk 6 is one example of an electron emission member and is made by impregnating a porous disk-shaped member composed of tungsten (W) with an electron emission material of $4BaO:CaO:Al_2CO_3$, a ternary metal oxide composed of barium (Ba), aluminum (Al), and calcium (Ca). It should also be noted that the electron emission material may be a binary barium oxide that does not contain CaO.

It is also to be noted that the electron emission material may be made of a metal such as a rare metal such as molybdenum, or an alloy such as iridium oxide (IrOx), either of which is capable of causing decrease in work function. Further, the electron emission material may contain strontium (Sr).

The tungsten disk 6 is mounted onto the cup 4 in a condition where it is attached to a cap 7. The cap 7, made of, for example, nickel, is a circular plate having almost the same outer diameter as the inner diameter of the cup 4, and is inserted into the cup 4 and fixed to its bottom by welding. In such a manner, the tungsten disk 6 is fixed to the bottom of the cup 4. It should be noted that the electron emission member may be cylindrical in shape and attached to an inside of the cup 4.

The electrode 3 is attached to one lead-in wire 8 which is inserted through the end of the glass tube 2 and held thereby. The lead-in wire 8 is consisted of an inner lead wire 8*a* that protrudes towards the inside of the glass tube 2 and an outer lead wire 8*b* that protrudes towards an outside of the glass tube 2, and the bottom of the cup 4 is fixed to a forward end of the inner lead wire 8*a* by welding. It should be noted that the inner lead wire 8*a* of the lead-in wire 8 is made of, for example, kovar (Kov) and its outer lead wire 8*b* is made of, for example, nickel.

It should be noted that the above-described coated region of the fluorescent substance 2*a* in an interior of the glass tube 2 extends slightly towards an outside of the forward end of the cup 4 of the electrode 3. The region where this fluorescent substance 2*a* is coated provides a light-emitting portion of the discharge lamp 1.

2. Operations of the Discharge Lamp

The following will describe operations of the discharge lamp 1 of the present embodiment. A voltage of, for example, about 1.5 kV is applied between the two electrodes 3 at a high frequency. This generates glow discharge, which heats the tungsten disk 6, thereby causing the electron emission material contained therein to emit electrons. It should be noted that after the occurrence of glow discharge, the voltage applied between the electrodes 3 is controlled to remain around, for example, 850V.

The electrons emitted from the tungsten disk 6, and thereafter accelerated, collide with mercury atoms and excite them. The mercury atoms thus excited emit ultraviolet light.

This ultraviolet light is converted by the fluorescent substance 2*a* into visible light, thereby rendering the discharge lamp 1 luminiferous.

It should be noted that the cup 4 has in it the porous tungsten disk 6 impregnated with an electron emission material and is thus prone to emit electrons. It is therefore possible to lower a temperature required to emit electrons.

The voltage applied between the electrodes 3 can thus be reduced. For example, in a conventional configuration, a voltage of about 1 kV used to be applied after the start of glow discharge, whereas in a configuration of the present embodiment, application of voltage can be reduced to about, for example, 850V. This lowers a drop in voltage at the cold cathode, thereby enhancing a luminous efficiency relative to dissipation power.

Further, provision of the tungsten disk 6 can increase the number of electrons to be emitted, thereby leading to increased luminance.

In addition, ions collide with the electrodes 3 to contribute to wearing of the cup 4 but provision of the collision-preventing ring 5 at the open end 4*a* of the cup 4 inhibits the cup 4 from wearing, by virtue of preventing ions generated during discharge from colliding with the cup 4. In consequence, the electrodes 3 can emit electrons over a longer period, thus prolonging their own service life as well as that of the discharge lamp 1.

In general terms, if the value of a current is increased, ion sputtering becomes conspicuous, despite an increase in the luminance. Accordingly, the cup wears faster according to a conventional construction of the electrodes, and service life is substantially abbreviated, thereby making it impossible to increase the luminance even when the current value is increased. In contrast, in the discharge lamp 1 of the present embodiment, the collision-preventing ring 5 is provided to the open end 4*a* of the cup 4, so that the cup can be inhibited from wearing even when the current value is increased. It is thus possible to enhance the luminance by increasing the current value while prolonging service life thereof.

Thus, the luminance of the discharge lamp 1 can be increased and if the discharge lamp 1 is used as, for example, a backlight directly below an LCD, it is possible to reduce the number of discharge lamps required to obtain a desired luminance all over a screen.

Further, the bottom of the cup 4 is provided with the tungsten disk 6 impregnated with an electron emission material, so as to prevent ions from colliding with this tungsten disk 6, thereby facilitating the inhibition of the scattering of the electron emission material.

Figure 1:
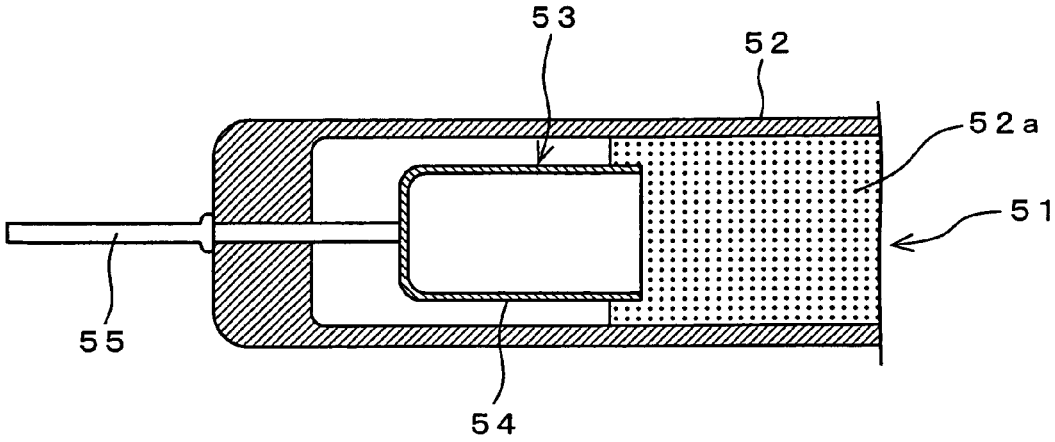
FIG. 1 is a cross-sectional view of important components of a configuration of a conventional cold-cathode type discharge lamp.
Figure 4:
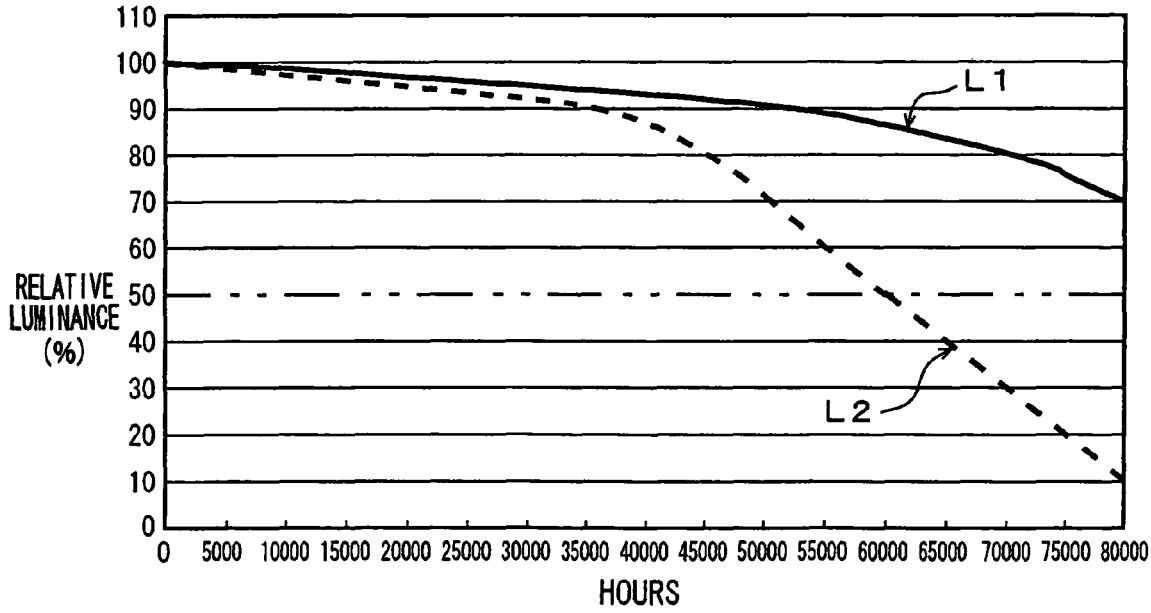
FIG. 4 is a graph comparing a service life of the discharge lamp of the present embodiment and that of the conventional discharge lamp.

FIG. 4 is a graph illustrating a comparison between a service life of the discharge lamp 1 of the present embodiment and that of the conventional discharge lamp, and also demonstrates a relationship between a relative luminance and a service life. As can be seen from a broken line L2 indicating a time-wise change in relative luminance of the conventional-structure discharge lamp shown in FIG. 1, as a result of wearing etc. of the electrodes caused by ion sputtering this discharge lamp of conventional structure demonstrates a luminance that drops to 50% of its original value within approximately 60,000 hours after starting to be used.

On the other hand, a solid line L1 indicates a time-wise change in relative luminance of the discharge lamp 1 of the present embodiment explained with reference to FIGS. 2A, 2B, and 3. In the discharge lamp 1 of the present embodiment, due to a configuration in which wearing of the electrodes 3 caused by ion sputtering is inhibited, and electrons are accordingly easily emitted, relative luminance is held at 50% or more of its original value even after the passage of 80,000 hours. Therefore, the service life of the discharge lamp 1 is determined not by the service life of the electrodes 3, but rather by that of the fluorescent substance 2*a* coated on the glass tube 2.

As described above, the configuration of a discharge lamp electrode related to the present invention includes an electron emission member containing an electron emission material in the inside of a cup, so that electrons may easily be emitted, thereby facilitating a lowering of temperature that is essential for the emission of electrons. In a discharge lamp equipped with such an electrode, it is possible to lower a level of voltage applied between the electrodes during operation, thereby suppressing a drop in voltage of a cold cathode. It is thus possible to enhance a luminous efficiency relative to dissipation power. It is also possible to increase the luminance because electrons to be emitted can be increased.

Moreover, a collision-preventing member is provided at an open end of the cup to cover the forward end of the cup, so that ions can be prevented from colliding with the cup, thus inhibiting the cup from wearing. It is thus possible to prolong the service life of the electrodes and, in consequence, that of the discharge lamp.

Further, although ion sputtering increases in intensity concomitantly with increases the value of the current, provision of the collision-preventing member can inhibit the cup from wearing, even when the level of current is high. It is thus possible to enhance the luminance of even a cold-cathode type discharge lamp, by intensifying the flow of a current.

INDUSTRIAL APPLICABILITY

The present invention provides a discharge lamp having enhanced luminous efficiency and longevity of service life, so that it can be applied as not only lighting appliances but also a backlight for LCDs etc., thus contributing to a prolongation of service life of the LCD and also reducing levels of energy dissipation.

The invention claimed is:

1. A discharge lamp, comprising:

an electrode at each of two opposed ends of a glass tube in which a gas containing a light-emitting material is enclosed and to an interior of which fluorescent substance is coated, wherein the electrode is provided with an electron emission member containing an electron emission material in a cup having such a shape that a bottom is provided therein, one end thereof is open and an inner cylindrical surface extends from the bottom to the open end;

wherein the electrode is provided with a ring-shaped collision-preventing member at the open end of the cup, said collision-preventing member having a sleeve portion and a flange portion, said sleeve portion having an outer diameter by which the sleeve portion is fitted to an opening of the cup and being fixed to the cup, and said flange portion having an outer diameter by which the flange portion covers the entire open end of the cup and covering the forward open end of the cup;

wherein the electron emission member is fixedly connected inside the cup adjacent to yet spaced-apart from the bottom of the cup;

wherein the electron emission member is cylindrically-shaped and has a first flat, disk-shaped surface, an opposing second flat, disk-shaped surface and a cylindrical surface interconnecting the first and second flat, disk-shaped surfaces with the cylindrical surface disposed apart from and facially opposing the inner cylindrical surface of the cup, the first flat, disk-shaped surface being fixedly connected inside the cup and the second, flat, disk-shaped surface facing the open end;

wherein the electrode includes a cap having a centrally-disposed base portion and a connecting portion integrally connected to and surrounding the base portion; and wherein the first flat, disk shaped surface of the electron emission member is connected to the base portion of the cap and is connected interiorly of the cup with the connecting portion of the cap being in contact with the bottom and a portion of the inner cylindrical surface of the cup adjacent the bottom.

2. The discharge lamp according to claim 1, wherein the electron emission member is made of any one of porous tungsten, molybdenum, and iridium oxide.

3. The discharge lamp according to claim 1, wherein the electron emission material is composed of an oxide of a combination of any ones selected from barium, calcium, aluminum, and strontium.

4. The discharge lamp according to claim 1, wherein the electron emission member is attached to the bottom of the cup.

5. The discharge lamp according to claim 1, wherein the collision-preventing member is made of a metal oxide.

6. A discharge lamp electrode equipped to each of two opposed ends of a glass tube in which a gas containing a light-emitting material is enclosed and to an interior of which fluorescent substance is coated, said discharge lamp electrode comprising:

an electron emission member containing an electron emission material in a cup having such a shape that a bottom is provided therein , one end thereof is open and an inner cylindrical surface extends from the bottom to the open end; and a ring-shaped collision-preventing member provided at the open end of the cup, the collision-preventing member having a sleeve portion and a flange portion, the sleeve portion having an outer diameter by which the sleeve portion is fitted to an opening of the cup and being fixed to the cup, and the flange portion having an outer diameter by which the flange portion covers the entire open end of the cup and covering the forward open end of the cup, wherein the electron emission member is fixedly connected inside the cup adjacent to yet spaced-apart from the bottom of the cup;

wherein the electron emission member is cylindrically-shaped and has a first flat, disk-shaped surface, an opposing second flat, disk-shaped surface and a cylindrical surface interconnecting the first and second flat, disk-shaped surfaces with the cylindrical surface disposed apart from and facially opposing the inner cylindrical surface of the cup, the first flat, disk-shaped surface being fixedly connected inside the cup and the second, flat, disk-shaped surface facing the open end, wherein the electrode includes a cap having a centrally-disposed base portion and a connecting portion integrally connected to and surrounding the base portion; and wherein the first flat, disk-shaped surface of the electron emission member is connected to the base portion of the cap and is connected interiorly of the cup with the connecting portion of the cap being in contact with the bottom and a portion of the inner cylindrical surface of the cup adjacent the bottom.

7. The discharge lamp electrode according to claim 6, wherein the electron emission member is made of any one of porous tungsten, molybdenum, and iridium oxide.

8. The discharge lamp electrode according to claim 6, wherein the electron emission material is composed of an oxide of a combination of any ones selected from barium, calcium, aluminum, and strontium.

* * * * *